United States Patent [19]

Streit et al.

[11] Patent Number: 4,890,537

[45] Date of Patent: Jan. 2, 1990

[54] ELEVATABLE FIRING WEAPON WITH A DEVICE FOR SETTING THE ELEVATION OF THE WEAPON BARREL

[75] Inventors: Roland Streit, Opfikon; Peter Mannhart, Eschenbach; Samuel Schmid, Dietlikon, all of Switzerland

[73] Assignee: Werkzeugmaschinenfabrik Oerlikon-Bührle AG, Zurich, Switzerland

[21] Appl. No.: 165,094

[22] Filed: Mar. 7, 1988

[30] Foreign Application Priority Data

Mar. 10, 1987 [CH] Switzerland ..... 00888/87

[51] Int. Cl.[4] ..... F41F 21/08

[52] U.S. Cl. ..... 89/37.11; 89/41.12; 188/300

[58] Field of Search ..... 89/37.11, 40.12, 41.12; 188/300

[56] References Cited

U.S. PATENT DOCUMENTS

| | | | |
|---|---|---|---|
| 2,378,409 | 6/1945 | Joy | 89/41.12 |
| 3,117,800 | 1/1964 | Magnuson | 188/300 |
| 3,343,619 | 9/1967 | Johansson | 89/41.12 |
| 3,562,901 | 2/1971 | Ray | 29/558 |
| 3,563,349 | 2/1971 | Spieth et al. | 188/300 |
| 3,575,087 | 4/1971 | Sherwood | 92/23 |
| 3,952,632 | 4/1976 | Eriksson et al. | 89/41.12 |
| 4,785,921 | 11/1988 | Hosan et al. | 188/300 |
| 4,793,450 | 12/1988 | Savenije | 188/300 |
| 4,828,080 | 5/1989 | Locher | 188/300 |

FOREIGN PATENT DOCUMENTS

| | | |
|---|---|---|
| 2424795 | 12/1974 | Fed. Rep. of Germany . |
| 2305645 | 10/1976 | France . |
| 966595 | 8/1964 | United Kingdom . |
| 1217263 | 4/1971 | United Kingdom . |

*Primary Examiner*—Stephen C. Bentley
*Attorney, Agent, or Firm*—Werner W. Kleeman

[57] ABSTRACT

In a firing weapon with an elevatable weapon barrel, it must be possible to fix or lock the weapon barrel in each desired position. For this purpose, known firing weapons are equipped with braking devices in which large frictional forces occur, thereby making it necessary to use servo-mechanisms. In accordance with the invention, the elevation of the weapon barrel is fixed or locked by means of a cylinder and a piston. The piston comprises a closeable through-passage opening through which a pressure medium flows, as long as the through-passage opening is open between a chamber located on one side or face of the piston into an other chamber located on the other side or face of the piston. The through-passage opening is closeable for fixing or locking the weapon barrel at a predeterminate elevation.

7 Claims, 3 Drawing Sheets

ELEVATABLE FIRING WEAPON WITH A DEVICE FOR SETTING THE ELEVATION OF THE WEAPON BARREL

BACKGROUND OF THE INVENTION

The present invention broadly relates to a new and improved construction of an elevatable firing weapon provided with a device for setting the elevation of the weapon barrel of the firing weapon.

In its more particular aspects, the present invention relates to a new and improved construction of elevatable firing weapon provided with a device for setting the elevation of the weapon barrel. This elevation setting or fixing device comprises two parts or components, namely a cylinder and a piston or piston member. The piston or piston member subdivides or partitions the cylinder into two chambers or compartments. One of the two parts is pivotably mounted at the weapon barrel, while the other of the two parts is pivotably mounted at a stationary weapon or gun mount or mounting. These two parts move relative to one another when the weapon barrel is elevated.

A power or force transmission device of the aforementioned type for setting the inclination of a weapon barrel is known, for example, from the German Published Patent Application No. 2,424,795, published Dec. 19, 1974 of the Swedish firm Bofors Ltd. This known device comprises a cylinder pivotably mounted at a weapon barrel and a piston pivotably mounted at a weapon mount or mounting by means of a piston rod. The displacement of the piston in the cylinder for raising or lowering, i.e. for elevating the weapon barrel, is effected by means of hydraulic oil. There is provided a second pressure medium of high compressibility, for example, a gas, which is located in a chamber of the cylinder. This second pressure medium or gas has a minimum volume in the lowered position of the weapon barrel and a maximum volume in the uppermost position of the weapon barrel. The entrapped gas thus functions as a compensating spring for counteracting the overload caused by the bearing at the weapon mounting.

Such a device is only necessary for weapon barrels in which the center of gravity of the weapon barrel is not located at the axis of elevation, thereby causing an overload. For weapons, in which the axis of elevation passes exactly through the center of gravity of the weapon barrel, there is no need for such a device. However, in such a weapon, the weapon barrel is very easily pivoted or tilted about its axis of elevation and the danger therefore exists, that the weapon barrel aimed or layed at a predetermined target can be unintentionally again pivoted or tilted and therefore no longer aimed or layed at the desired target. In such a weapon it is therefore necessary to fix or lock the weapon barrel which has been pivoted or tilted to the desired elevation. Clamping devices are therefore customary, by means of which the weapon barrel can be fixed or locked in the desired position by turning a bolt or screw. However, such clamping devices are complicated to operate and hardly reliable when the bolts or screws are insufficiently or inadequately tightened.

SUMMARY OF THE INVENTION

Therefore, with the foregoing in mind, it is a primary object of the present invention to provide a new and improved construction of an elevatable firing weapon containing a device for setting the elevation of the weapon barrel in a manner which does not exhibit the aforementioned drawbacks and shortcomings of the prior art constructions.

Another and more specific object of the present invention aims at providing a new and improved construction of an elevatable firing weapon provided with a device for setting the elevation of the weapon barrel by means of which it is possible to fix or set the weapon barrel at a desired or predeterminate elevation, whereby the fixing or setting of the weapon barrel is independent of the static friction of a clamping device.

A further important object of the present invention aims at providing a new and improved construction of an elevatable firing weapon with a device for setting the elevation of the weapon barrel and which setting device is relatively simple in construction and design, highly reliable in operation, extremely simple to use and requires a minimum of servicing and maintenance.

Now in order to implement these and still further objects of the invention, which will become more readily apparent as the description proceeds, the elevatable firing weapon provided with a device for setting the elevation of a weapon barrel as contemplated by the present invention is manifested by the features that the piston or piston member possesses a closeable through-passage or throughpass opening or passage through which the pressure medium flows, as long as the closeable through-passage or throughpass opening or passage is open, from the one chamber or compartment located at the one side or face of the piston or piston member into the other chamber or compartment located at the other side or face of the piston or piston member. The through-passage or throughpass opening or passage is closeable for locking the weapon barrel at a predeterminate or desired elevation or elevational position, such that the piston or piston member is blocked in the cylinder and the weapon barrel is locked.

Preferably, two actuatable non-return or check valves are provided in the closeable through-passage or throughpass opening or passage of the piston or piston member.

This construction has the advantage that no large forces, such as occur in clamping or braking mechanisms, are required for fixing or locking the weapon barrel at a predeterminate or desired elevation.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
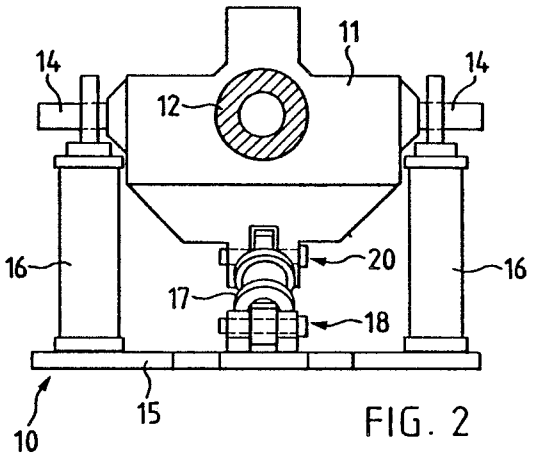
FIG. 1 shows a side view of a part of the elevatable firing weapon or weapon system with a device for setting the elevation of the weapon barrel.
Figure 2:
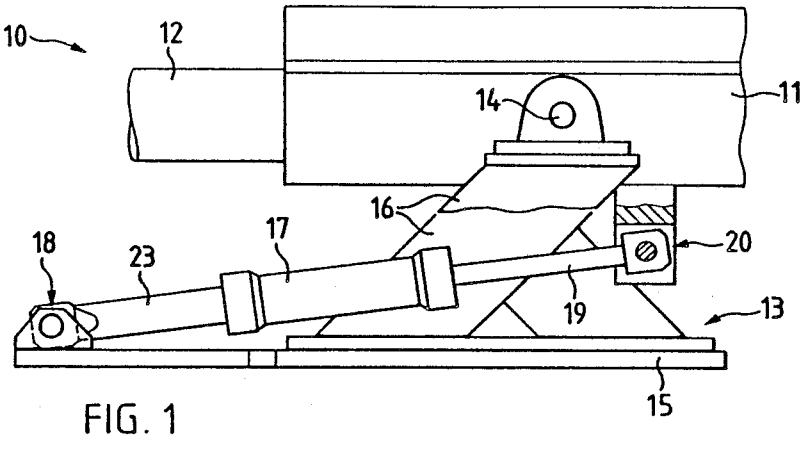
FIG. 2 shows a front view of the elevatable firing weapon or weapon system illustrated in FIG. 1.
Figure 3:
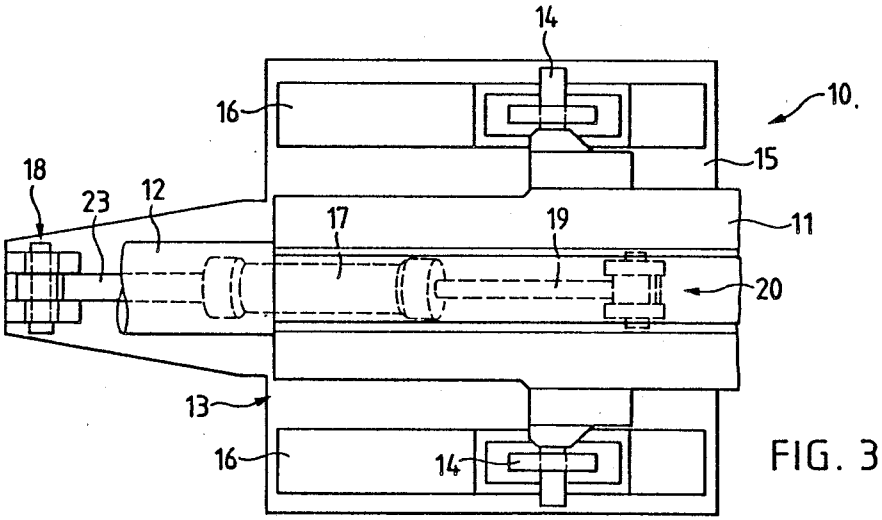
FIG. 3 shows a top plan view of the elevatable firing weapon or weapon system illustrated in FIG. 1.

Describing now the drawings, it is to be understood that to simplify the showing thereof only enough of the construction of the elevatable firing weapon or weapon system provided with a device for setting or fixing the elevation or elevational position of the weapon barrel has been illustrated therein as is needed to enable one skilled in the art to readily understand the underlying principles and concepts of this invention. Turning now specifically to FIGS. 1 to 3 of the drawings, the elevatable firing weapon or weapon system 10 with a device for setting the elevation of a weapon barrel 12, and illustrated therein by way of example and not limitation, will be seen to comprise a weapon housing 11. The weapon barrel 12 is appropriately mounted at the weapon housing 11. This firing weapon 10 is pivotably mounted for pivotable movement about an axis of elevation or elevational axis 14 at a weapon mount or mounting 13 or equivalent structure.

As illustrated in FIG. 2, the weapon mount or mounting 13 is composed of a base or bottom plate 15 and two supports or support members 16. The firing weapon 10 is pivotably mounted at these two supports or support members 16 and can be elevated through an angle of approximately 45° to 50° out of the depicted horizontal position. This elevation of the firing weapon 10 is effected manually by the weaponry gunner. No further auxiliary or supplementary means are provided. The device or apparatus hereinafter described serves to infinitely fix or lock the firing weapon 10 at each desired elevation or elevational position.

According to FIG. 1 of the drawings, this device comprises a cylinder or cylinder member 17 which is pivotably mounted at the base or bottom plate 15 by means of a pivot or hinged support or pivot joint 18. A piston rod or rod member 19 extends out of this cylinder 17 and is pivotably mounted at the weapon housing 11 by means of a pivot or hinged support or pivot joint 20. As can be seen from FIG. 4, the piston rod 19 with a piston or piston member 25 fastened thereat moves with respect to the cylinder 17 when the firing weapon 10 is elevated. This piston is not visible in FIG. 1. The construction of this device is however illustrated in detail in FIGS. 4 and 5.

Figure 4:
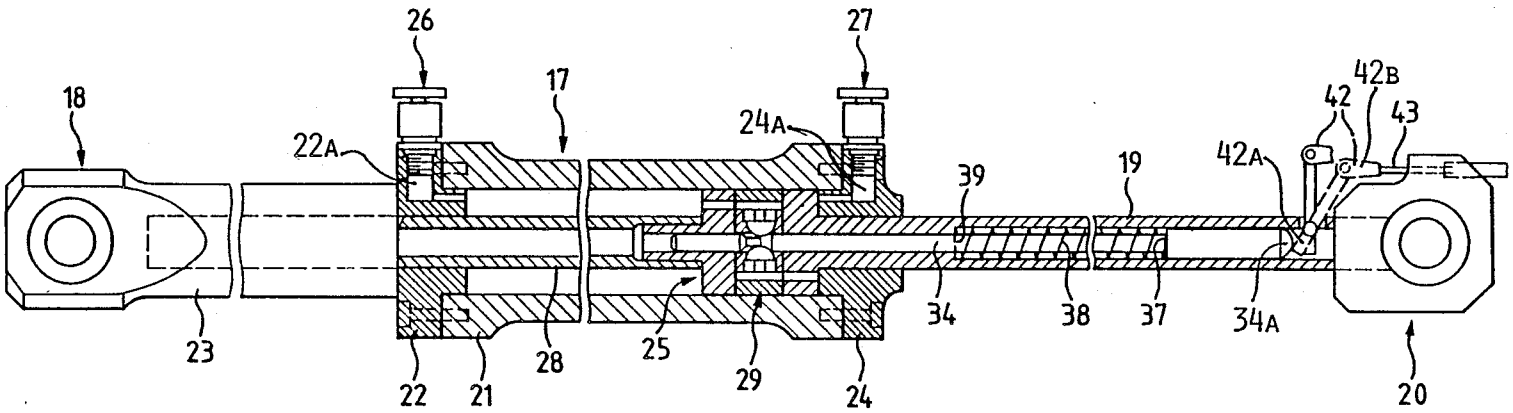
FIG. 4 shows, on an enlarged scale, a longitudinal vertical section through an exemplary embodiment of the device for setting or fixing the elevation or elevational position of the weapon barrel of the firing weapon or weapon system and constructed according to the invention.
Figure 5:
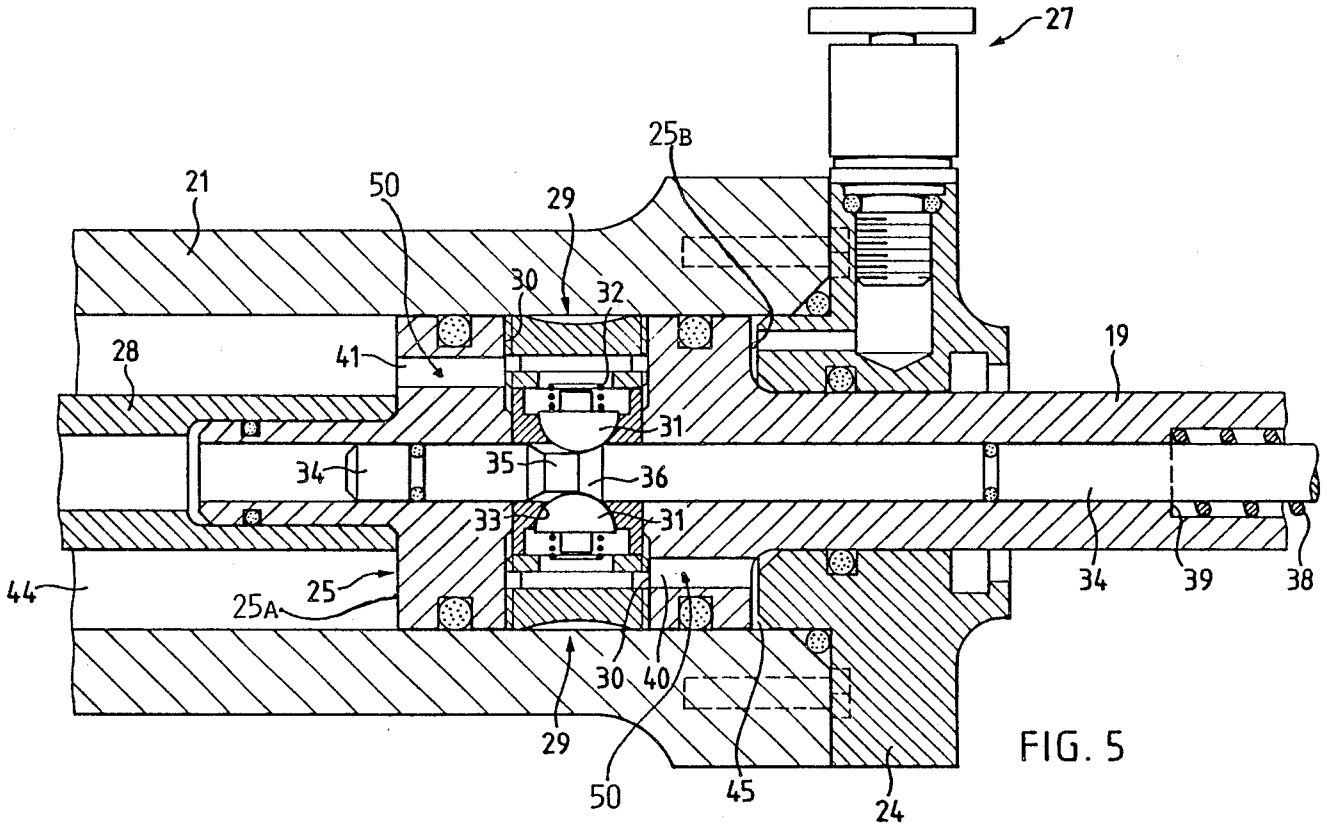
FIG. 5 shows, on a still greater enlarged scale, a portion of the arrangement illustrated in FIG. 4.

According to the illustration of FIG. 4 of the drawings, the cylinder 17 comprises a tube or tubular member 21 which is shown in a markedly shortened manner. This tube or tubular member 21 is closed at its left end of the showing of FIG. 4 by means of a cover or cap member 22. A further tube or tubular member 23 is fastened to this cover or cap member 22. This tube or tubular member 23 is provided at its left end of the showing of FIG. 4 with the pivot or hinged support or pivot joint 18. Furthermore, the tube or tubular member 21 is closed at its end depicted at the right side of FIG. 4 by means of a second cover or cap member 24. The piston rod 19 extends through this cover or cap member 24 and comprises at its end shown at the left side of FIG. 4 a piston or piston member 25 and at its end located on the right side of such FIG. 4 the pivot support or pivot joint 20. A suitable pressure medium, such as oil, can be filled into the cylinder 17 through filler or charging openings 22A and 24A respectively provided in the cover or cap members 22 and 24. These filler or charging openings 22A and 24A are respectively closeable by means of two cap screws or closure elements 26 and 27 so that a constant pressure can be built up in the cylinder 17.

In order that the pressure medium bears against surface areas of the same size at both sides or faces 25A and 25B of the piston or piston member 25, there is mounted a hollow piston rod 19 and 28 at each of both sides or faces of the piston 25. The piston or piston member 25 is thus connected on the right side with the aforementioned piston rod or rod member 19 and on the left side with the further piston rod or rod member 28. This further piston rod 28 extends through the aforementioned cap or cover member 22. As long as the same pressure prevails on both sides or faces 25A and 25B of the piston 25 and this piston 25 is absolutely tight, then the piston 25 cannot move within the cylinder 17.

In order that the piston 25 can be moved in the cylinder 17, a closeable through-passage or throughpass opening or passage, generally indicated by reference character 50, is provided in the piston or piston member 25. In accordance with the showing of FIG. 5, this through-passage or throughpass opening or passage 50 of the piston 25 is provided with two actuatable non-return or check valves 29 or equivalent structure located in respective radial bores 30 of the piston 25. Each of these non-return or check valves 29 comprises a displaceable substantially hemispherical or dome-shaped element 31 which is pressed by an associated spring 32 against a related sealing or valve seat 33. To actuate the hemispherical or dome-shaped elements 31, i.e. to lift the hemispherical or dome-shaped elements 31 off their respective sealing or valve seats 33, there is provided a displaceable rod or bar member 34 having an annular or ring-shaped recess or cutout 35. This annular or ring-shaped recess or cutout 35 is defined or limited on one side by a substantially conical or tapered surface 36 which serves to actuate the hemispherical or dome-shaped elements 31.

The displaceable rod or bar member 34 is provided with a shoulder portion 37. As shown in FIG. 4, one end of a pressure or compression spring 38 bears upon this shoulder portion 37. At its other end, the pressure spring 38 bears upon a shoulder portion or shoulder 39 of the piston rod 19. This pressure or compression spring 38 tends to push or displace the rod or bar member 34 so far to the right, that the conical or tapered surface 36 moves out of the region of the hemispherical or dome-shaped elements 31 and the non-return or check valves 29 are closed. For opening the two non-return or check valves 29, the rod or bar member 34 must be displaced so far to the left, until the conical or tapered surface 36 lifts off the two hemispherical or dome-shaped elements 31 from their respective sealing or valve seats 33. The moment the hemispherical or dome-shaped elements 31 are lifted off their sealing or valve seats 33, then the pressure medium can flow from one side or face 25A or 25B of the piston or piston member 25 to the other side or face 25A or 25B thereof, as the case may be. The pressure medium passes, for instance, from the side of the piston face 25B through a first axial bore or channel 40 to the first non-return or check valve 29, then to the second non-return or check valve 29 and finally passes through a second axial bore or channel 41 to the other side or face 25A of the piston or piston member 25. The axial bores or channels 40 and 41 define the aforementioned through-passage or throughpass opening or passage 50 provided with the non-return or check valves or valve structure 29. This flow pattern can be of course reversed, depending on the direction in which the piston or piston member 25 is to be displaced.

A double or two-armed lever 42 or equivalent structure is pivotably mounted at the piston rod 19 and serves to actuate or displace the rod or bar member 34. One arm 42A of the two-armed lever 42 bears upon the end 34A of the rod or bar member 34, while a pull wire or traction cable 43 or the like is pivotably supported or articulated at the other arm 42B of the two-armed lever 42. When the pull wire or traction cable 43 is pulled, the two-armed lever 42 turns or revolves in clockwise direction into the position illustrated in dotted lines in FIG. 4, thus displacing the rod or bar 34 to the left, such that both non-return or check valves 29 open, so that the piston or member 25 can be freely moved to the right or to the left. The firing weapon 10 can thereby be elevated to any desired elevation or elevational position. By releasing the pull wire or traction cable 43, the rod or bar member 34 is displaced by the pressure or compression spring 38 so far to the right of the showing of FIG. 4, that the two non-return or check valves 29 close and the piston member 25 no longer can be moved. Consequently, the firing weapon 10 is positively locked in desired position and cannot be further elevated. In other words, the angle of elevation can neither be increased nor decreased until the device is again operated in the manner heretofore described.

While there are shown and described present preferred embodiments of the invention, it is to be distinctly understood that the invention is not limited thereto, but may be otherwise variously embodied and practiced within the scope of the following claims.

Accordingly, what we claim is:

1. An elevatable firing weapon containing a weapon barrel and provided with a device for setting the elevation of the weapon barrel, comprising:

two parts;

one of said two parts comprising a cylinder;

the other one of said two parts comprising piston means;

said piston means subdividing said cylinder into two chambers;

a stationary weapon mounting;

means for pivotably mounting one of said two parts at said weapon barrel;

means for pivotably mounting the other of said two at said stationary weapon mounting;

said two parts moving relative to one another when said weapon barrel is elevated;

said piston means comprising a piston having oppositely situated sides;

said piston being provided with means defining a closable passage through which a pressure medium can flow, when said closable passage is open, from one of said two chambers which is located at one side of said piston into the other one of said two chambers which is located at the other side of said piston;

means for closing said closable passage for locking said weapon barrel at a predeterminate elevational position;

means for operating said closing means; and said closing means blocking said piston in said cylinder in order to lock said weapon barrel in said predeterminate elevational position;

said means defining said closable passage comprising:

a radial bore extending through said piston;

a first channel flow communicating with said radial bore and one side of said piston; and a second channel flow communicating with said radial bore and the other side of said piston.

2. The firing weapon as defined in claim 1, wherein:

said means for closing said closeable passage comprising check valve means located in said closeable passage.

3. The firing weapon as defined in claim 2, wherein:

said cylinder has opposite ends;

a sealing cover member provided at each opposite end of said cylinder;

each sealing cover member being provided with a filling opening for infeed of the pressure medium into said two chambers; and a sealing cap screw provided at each of said two sealing cover members for closing said filling openings.

4. The firing weapon as defined in claim 3, wherein:

said piston means comprises a first piston rod mounted to be axially displaceable within one of said two chambers;

said first piston rod having oppositely situated ends;

said first piston rod extending at one of said oppositely situated ends outwardly through a related one of said two sealing cover members;

said first piston rod being connected at the other oppositely situated end with one side of said piston;

said piston means further comprising a second piston rod mounted to be axially displaceable within the other one of said two chambers;

said second piston rod having oppositely situated ends;

said second piston rod extending at one of said oppositely situated ends outwardly through a related other one of said two sealing cover members; and said second piston rod being connected at said other oppositely situated end with the other oppositely situated side of said piston.

5. The firing weapon as defined in claim 4, wherein:

said first piston rod comprising a hollow piston rod connected to said piston at said one side thereof such that said one side of said piston defines a predetermined first surface area for said pressure medium in one of said two chambers;

said second piston rod comprising a hollow piston rod and being connected to said other oppositely situated side of said piston such that said other oppositely situated side of said piston defines a predetermined second surface area for said pressure medium in the other one of said two chambers; and said first and second predetermined surface areas being essentially equal to one another.

6. The firing weapon as defined in claim 5, wherein:

said means for operating said closing means comprises:

a rod member displaceably mounted in said first piston rod;

said closing means comprising valve means;

said rod member having means for actuating valve means;

a pressure spring having opposite ends and extending axially within said first piston rod;

said rod member having a shoulder portion for supporting one end of said opposite ends of said pressure spring;

said first piston rod being provided with a shoulder portion for supporting the other end of said opposite ends of said pressure spring; and said operating means including means for axially displacing said rod member within said first piston rod against the force of said pressure spring, such that said actuating means of said rod member can actuate said valve means.

7. The firing weapon as defined in claim 6, wherein:

said axially displacing means comprising a two-armed lever rotatably mounted at said first piston rod;

said two-armed lever having first and second arms;

a traction wire pivotably mounted at one arm of said two-armed lever; and the other arm of said two-armed lever bearing against an end of said rod member.

* * * * *